US010593275B2

(12) United States Patent
Liu et al.

(10) Patent No.: US 10,593,275 B2
(45) Date of Patent: Mar. 17, 2020

(54) ELECTRONIC PAPER DISPLAY

(71) Applicant: E Ink Holdings Inc., Hsinchu (TW)

(72) Inventors: Shu-Cheng Liu, Hsinchu (TW); Pei-Lin Tien, Hsinchu (TW); Chi-Mao Hung, Hsinchu (TW)

(73) Assignee: E Ink Holdings Inc., Hsinchu (TW)

( * ) Notice: Subject to any disclaimer, the term of this patent is extended or adjusted under 35 U.S.C. 154(b) by 0 days.

(21) Appl. No.: 15/795,284

(22) Filed: Oct. 27, 2017

(65) Prior Publication Data

US 2018/0182332 A1 Jun. 28, 2018

(30) Foreign Application Priority Data

Dec. 26, 2016 (CN) ..... 2016 1 1215536

(51) Int. Cl.

| | |
|---|---|
| ***G09G 3/36*** | (2006.01) |
| ***G09G 3/20*** | (2006.01) |
| ***G09G 3/34*** | (2006.01) |

(52) U.S. Cl.

CPC ..... *G09G 3/3655* (2013.01); *G09G 3/2096* (2013.01); *G09G 3/344* (2013.01); *G09G 3/3614* (2013.01); *G09G 2310/0243* (2013.01); *G09G 2310/0254* (2013.01); *G09G 2310/0264* (2013.01); *G09G 2380/02* (2013.01)

(58) Field of Classification Search

CPC .... G09G 3/344; G09G 3/3614; G09G 3/2096; G09G 3/3655

See application file for complete search history.

(56) References Cited

U.S. PATENT DOCUMENTS

| | | | | |
|---|---|---|---|---|
| 2003/0137521 | A1* | 7/2003 | Zehner | G02F 1/167 345/589 |
| 2006/0139304 | A1 | 6/2006 | Goden | |
| 2014/0078035 | A1 | 3/2014 | Sato et al. | |
| 2014/0085288 | A1 | 3/2014 | Choi et al. | |

(Continued)

FOREIGN PATENT DOCUMENTS

| | | |
|---|---|---|
| CN | 101441854 | 5/2009 |
| CN | 102044218 | 5/2011 |

(Continued)

OTHER PUBLICATIONS

"Office Action of China Counterpart Application", dated May 24, 2019, p. 1-p. 8.

*Primary Examiner* — Vijay Shankar
*Assistant Examiner* — Cory A Almeida
(74) *Attorney, Agent, or Firm* — JCIPRNET

(57) ABSTRACT

An electronic paper display including a display apparatus of a first type, a driver circuit of the first type electrically coupled to the display apparatus of the first type, a display film of a second type disposed on the display apparatus of the first type and a timing controller circuit of the second type electrically coupled to the driver circuit of the first type is provided. The driver circuit of the first type drives the display apparatus of the first type and displays images on the display film of the second type according to a driving signal of the first type. The timing controller circuit of the second type adjusts a waveform of driving signal of the second type to a waveform of the driving signal of the first type. The first type is a liquid crystal display type, and the second type is an electronic paper display type.

9 Claims, 5 Drawing Sheets

(56) References Cited

U.S. PATENT DOCUMENTS

| | | | |
|---|---|---|---|
| 2014/0266995 | A1 | 9/2014 | Cho et al. |
| 2015/0187334 | A1 | 7/2015 | Oh et al. |
| 2015/0221248 | A1 | 8/2015 | Kim et al. |
| 2015/0255029 | A1 | 9/2015 | Niikura et al. |

FOREIGN PATENT DOCUMENTS

| | | |
|---|---|---|
| CN | 104252848 | 12/2014 |
| CN | 105321477 | 2/2016 |

* cited by examiner

ELECTRONIC PAPER DISPLAY

CROSS-REFERENCE TO RELATED APPLICATION

This application claims the priority benefit of China application serial no. 201611215536.0, filed on Dec. 26, 2016. The entirety of the above-mentioned patent application is hereby incorporated by reference herein and made a part of this specification.

BACKGROUND OF THE INVENTION

1. Field of the Invention

The invention relates to a display panel, and more particularly, to an electronic paper display.

2. Description of Related Art

In recent years, as display panels gradually developed to be lighter and thinner, electronic paper display panels have become one of the display panels in line with the needs of the public. With advantages of thinness and lightness, durability and low power consumption for energy saving and environmental protection, electronic paper display panels have been widely applied in electronic readers (e.g., electronic books, electronic newspapers) or other electronic components (e.g., electronic tags) on the market.

In the existing technology, due to limitations on the material and process architecture of the electronic paper, it requires a thin film transistor back panel and a driving chip to be redesigned so an exclusive timing controller of the electronic paper display can be used to drive the electronic paper display panel according to its characteristic and driving waveform in order to display desired image data. Nonetheless, redesigning the thin film transistor back panel and the driving chip leads to more development costs.

SUMMARY

The invention is directed to an electronic paper display, which is capable of directly replacing a liquid crystal layer of a liquid crystal display by a display film of an electronic paper together with a timing controller circuit of the invention, the existing liquid crystal display apparatus can then be utilized to drive the electronic paper display panel thereby saving the development costs.

The electronic paper display of the invention includes a display apparatus of a first type, a display film of a second type disposed on the display apparatus of the first type, a driver circuit of the first type electrically coupled to the display apparatus of the first type and a timing controller circuit of the second type electrically coupled to the driver circuit of the first type. The driver circuit of the first type drives the display apparatus of the first type and displays an image frame on the display film of the second type according to a driving signal of the first type. The timing controller circuit of the second type adjusts a waveform of driving signal of the second type to a waveform of the driving signal of the first type. The first type is a liquid crystal display type, and the second type is an electronic paper display type.

In an embodiment of the invention, the waveform of the driving signal of the first type and the waveform of the driving signal of the second type each includes a plurality of frame periods. A time interval of each of the time periods of the waveform of the driving signal of the first type is greater than a time interval of each of the time periods of the waveform of the driving signal of the second type.

In an embodiment of the invention, the waveform of the driving signal of the first type in each of the frame periods is different from the waveform of the driving signal of the second type in each of the frame periods.

In an embodiment of the invention, the waveform of the driving signal of the first type in each of the frame periods includes a first level and a second level, or the second level and a third level.

In an embodiment of the invention, the waveform of the driving signal of the second type in each of the frame periods includes a fourth level or a fifth level.

In an embodiment of the invention, the driver circuit of the first type includes a source driver circuit. The source driver circuit is configured to drive the display apparatus of the first type utilizing a polarity inversion method.

In an embodiment of the invention, the display apparatus of the first type includes a plurality of transistor circuits. The driver circuit of the first type drives all the transistor circuits by the same waveform of the driving signal of the first type.

In an embodiment of the invention, the display apparatus of the first type includes a plurality of first transistor circuits and a plurality of second transistor circuits. The waveform of the driving signal of the first type for driving the first transistor circuits is different from the waveform of the driving signal of the first type for driving the second transistor circuits.

In an embodiment of the invention, the polarity inversion method is one selected from a frame inversion method, a line inversion method and a column inversion method and a dot inversion method.

Based on the above, according to the embodiments of the invention, the display film of the electronic paper display is integrated with the display apparatus and the driver circuit of the liquid crystal display type in low costs and driven according to the principle of the liquid crystal display so that the electronic paper display can display the image data accordingly.

To make the above features and advantages of the disclosure more comprehensible, several embodiments accompanied with drawings are described in detail as follows.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
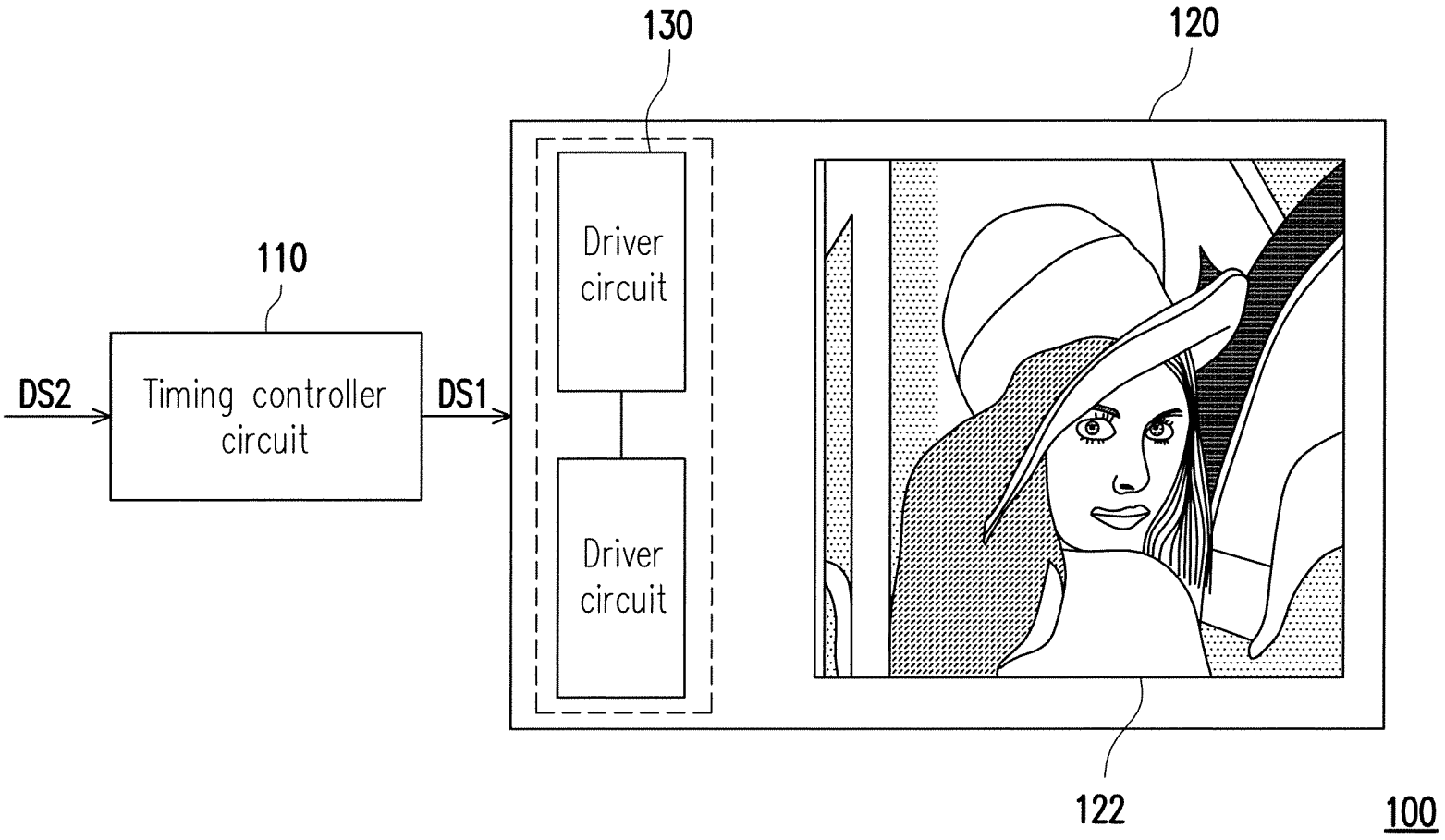
FIG. 1 is a schematic diagram illustrating an electronic paper display according to an embodiment of the invention.

Reference will now be made in detail to the present preferred embodiments of the invention, examples of which are illustrated in the accompanying drawings. Wherever possible, the same reference numbers are used in the drawings and the description to refer to the same or like parts.

Embodiments are provided below to describe the invention in detail, though the invention is not limited to the provided embodiments, and the provided embodiments can be suitably combined. The terms "coupled" and "electrically coupled" used in this specification (including claims) of the present application may refer to any direct or indirect connection means. For example, "a first apparatus is coupled or electrically coupled to a second apparatus" can be interpreted as "the first apparatus is directly connected to the second apparatus" or "the first apparatus is indirectly connected to the second apparatus through other connection means". In addition, the term "signal" can refer to a current, a voltage, a charge, a temperature, data, electromagnetic wave or any one or multiple signals.

FIG. 1 is a schematic diagram illustrating an electronic paper display according to an embodiment of the invention. Referring to FIG. 1, an electronic paper display 100 of the present embodiment includes a timing controller circuit 110, a display apparatus 120, a display film 122 and a driver circuit 130. In the present embodiment, the display film 122 and the driver circuit 130 are disposed on the display apparatus 120. The driver circuit 130 is configured to drive the display apparatus 120 and display an image frame on the display film 122. In another embodiment, the driver circuit 130 may also be disposed independent outside the display apparatus 120.

In the present embodiment, the display apparatus 120 and the driver circuit 130 are of a liquid crystal display type. The display apparatus 120 includes a thin film transistor back panel, a power circuit and modules of the liquid crystal display type. The timing controller circuit 110 and the display film 122 are of an electronic paper display type. The architecture of the electronic paper display 100 includes integration of the following four elements: the timing controller circuit 110 and the display film 122 adapted to the electronic paper display, and the display apparatus 120 and the driver circuit 130 adapted to a liquid crystal display. As such, the timing controller circuit 110 can adjust a waveform of the driving signal DS2 adapted to the electronic paper display to a waveform of a driving signal DS1 adapted to the liquid crystal display. The driver circuit 130 drives the display apparatus 120 and displays the image frame on the display film 122 according to the driving signal DS1 adapted to the liquid crystal display.

Therefore, in the present embodiment, the electronic paper display 100 includes a new electronic paper driver architecture, which can combine use of the display film 122 adapted to the electronic paper display together with the display apparatus 120 and the driver circuit 130 adapted to the liquid crystal display. Further, the display apparatus 120 is driven according to a driving principle of the liquid crystal display so the electronic paper display 100 can be driven according to the waveform of the driving signal DS1 adapted to the liquid crystal display thereby displaying the image data.

In the present embodiment, each of the timing controller circuit 110, the display apparatus 120, the driver circuit 130 and the display film 122 may be implemented by a suitable component architecture in the related field, which is not particularly limited by the invention.

In the present embodiment, the driver circuit 130 includes, for example, a source driver circuit (not illustrated). The driver circuit 130 drives transistor circuits on the display apparatus 120 by a polarity inversion method, such as one of a frame inversion method, a line inversion method, a column inversion method and a dot inversion method. The frame inversion method and the dot inversion method are used below as examples for explaining how the timing controller circuit 110 is driven to adjust the waveform of the driving signal DS2 adapted to the electronic paper display to the waveform of a driving signal DS1 adapted to the liquid crystal display.

Figure 2:
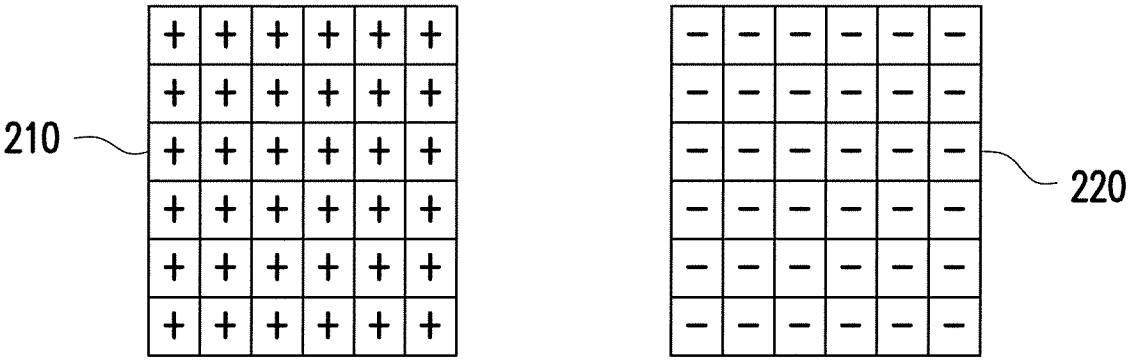
FIG. 2 is a schematic diagram illustrating a display apparatus driven by a frame inversion method according to an embodiment of the invention.
Figure 3:
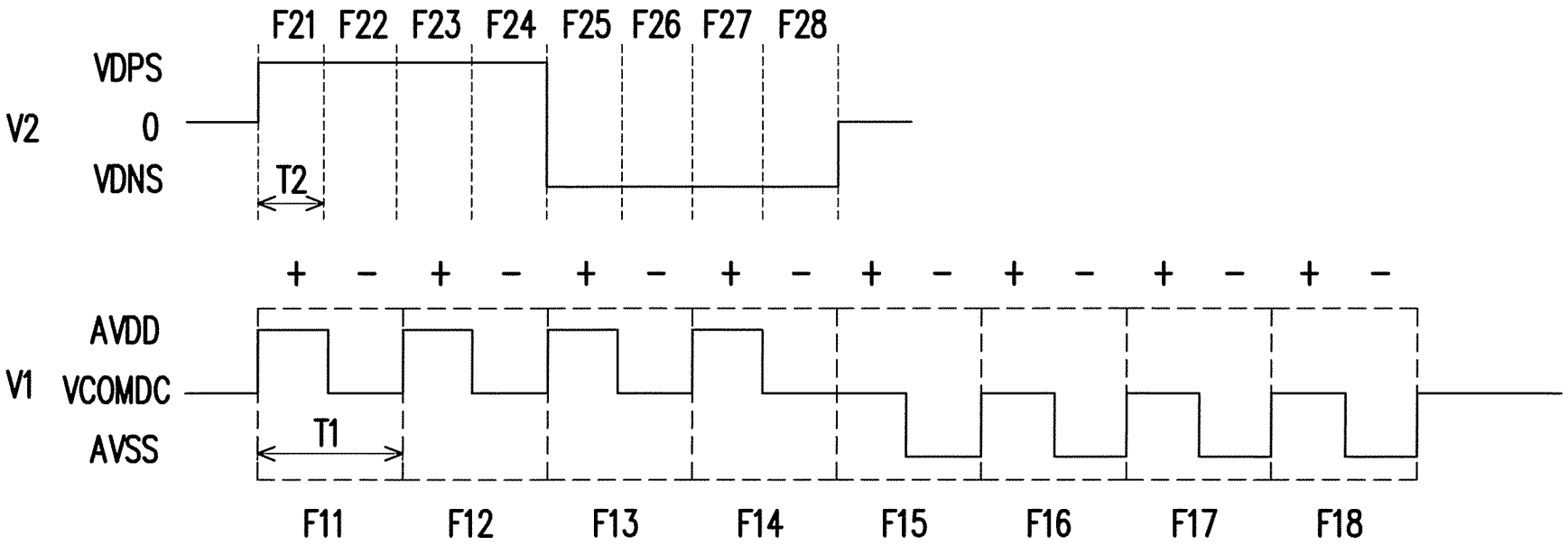
FIG. 3 is a schematic diagram illustrating a waveform of a driving signal according to an embodiment of the invention.

FIG. 2 is a schematic diagram illustrating a display apparatus driven by a frame inversion method according to an embodiment of the invention. FIG. 3 is a schematic diagram illustrating a waveform of a driving signal according to an embodiment of the invention. Referring to FIG. 2 and FIG. 3, in the present embodiment, the driver circuit 130 drives the display apparatus 120 by the frame inversion method, for example. In a first frame period, the driver circuit 130 drives the transistor circuit of each pixel by, for example, a positive polarity, as shown by a polarity distribution 210. In a second frame period, the driver circuit 130 drives the transistor circuit of each pixel by, for example, a negative polarity, as shown by a polarity distribution 220. In the present embodiment, the driver circuit 130 drives all the transistor circuits using the same driving signal V1.

In the present embodiment, the timing controller circuit 110 receives, for example, a driving signal V2 adapted to the electronic paper display. The driving signal V2 includes a plurality of frame periods F21 to F28. The driving signal V2 can include a high level VDPS (a fourth level), a zero level 0 and a low level VDNS (a fifth level). In each of the frame periods F21 to F24, the driving signal V2 includes the high level VDPS. In each of the frame periods F25 to F28, the driving signal V2 includes the low level VDNS. Accordingly, in the present embodiment, the waveform of the driving signal V2 in each of the frame periods includes the high level VDPS (in the frame periods F21 to F24) or the low level VDNS (in the frame periods F25 to F28).

In the present embodiment, the timing controller circuit 110 adjusts the driving signal V2 to the driving signal V1. The driving signal V1 includes a plurality of frame periods F11 to F18. The driving signal V1 can include a high level AVDD (a first level), a common voltage level VCOMDC (a second level) and a low level AVSS (a third level). In correspondence to the frame periods F21 to F24, the driving signal V1 includes the high level AVDD and the common voltage level VCOMDC in each of the frame periods F11 to F14. For instance, in the frame period F11, the driving signal V1 is dropped from the high level AVDD to the common voltage level VCOMDC. In correspondence to the frame periods F25 to F28, the driving signal V1 includes the common voltage level VCOMDC and the low level AVSS in each of the frame periods F15 to F18. For instance, in the frame period F15, the driving signal V1 is dropped from the common voltage level VCOMDC to the low level AVSS. Therefore, in the present embodiment, the waveform of the driving signal V1 in each of the frame periods includes the high level AVDD and the common voltage level VCOMDC (in the frame periods F11 to F14), or the common voltage level VCOMDC and the low level AVSS (in the frame periods F15 to F18).

Hence, in the present embodiment, the waveform of the driving signal V1 in each of the frame periods is different from the waveform of the driving signal V2 in each of the frame periods. For instance, the waveform of the driving signal V1 in the frame period F11 is different from the waveform of the driving signal V2 in the frame period F21. The waveform of the driving signal V1 in the frame period F15 is different from the waveform of the driving signal V2 in the frame period F25. In the present embodiment, a time interval T1 of each of the frame periods F11 to F18 of the waveform of the driving signal V1 is greater than a time interval T2 of each of the frame periods F21 to F28 of the waveform of the driving signal V2. In the present embodiment, the levels, the waveforms, and the numbers and lengths of the frame periods of the driving signals V1 and V2 are merely examples, and the invention is not limited thereto.

Figure 4:
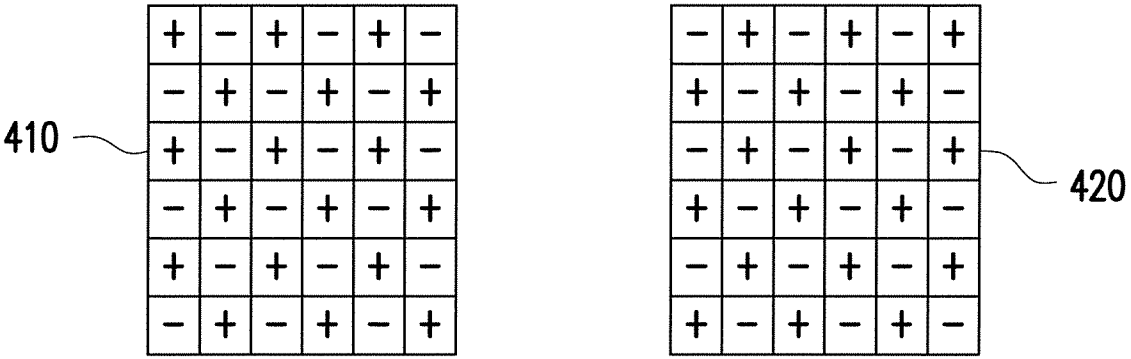
FIG. 4 is a schematic diagram illustrating a display apparatus driven by a dot inversion method according to an embodiment of the invention.
Figure 5:
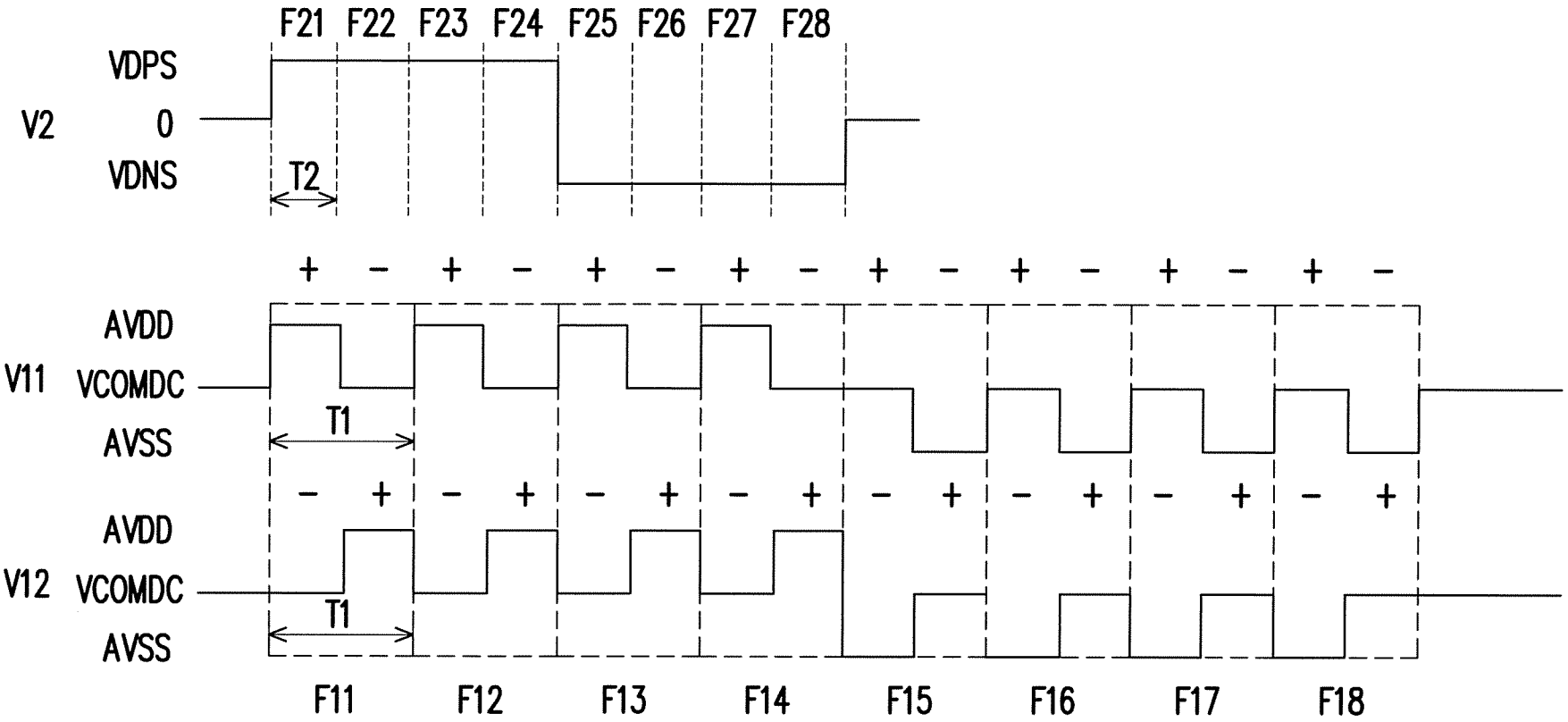
FIG. 5 is a schematic diagram illustrating a waveform of the driving signal according to another embodiment of the invention.

FIG. 4 is a schematic diagram illustrating a display apparatus driven by a dot inversion method according to an embodiment of the invention. FIG. 5 is a schematic diagram illustrating a waveform of a driving signal according to an embodiment of the invention. Referring to FIG. 4 and FIG. 5, in the present embodiment, the driver circuit 130 drives the display apparatus 120 by the dot inversion method, for example. In a first frame period, the driver circuit 130 drives the transistor circuit of each pixel by, for example, the respective polarity as shown in a polarity distribution 410. In a second frame period, the driver circuit 130 drives the transistor circuit of each pixel by, for example, the respective polarity as shown in a polarity distribution 420. In the present embodiment, the driver circuit 130 drives all the transistor circuits using different driving signals V11 and V12. For instance, in the first frame period, the driver circuit 130 drives the transistor circuits corresponding to odd-number pixels by the driving signal V11, and drives the transistor circuits corresponding to even-number pixels by the driving signal V12, for example. In the second frame period, the driver circuit 130 drives the transistor circuits corresponding to even-number pixels by the driving signal V11, and drives the transistor circuits corresponding to odd-number pixels by the driving signal V12, for example.

In the present embodiment, the timing controller circuit 110 receives, for example, the driving signal V2 adapted to the electronic paper display, where enough teaching, suggestion, and description regarding a waveform thereof can be obtained from the description for the embodiment of FIG. 3, which is not repeated hereinafter.

In the present embodiment, the timing controller circuit 110 adjusts the driving signal V2 to the driving signals V11 and V12. A waveform of the driving signal V11 is similar to that of the driving signal V1, where enough teaching, suggestion, and description regarding the same can be obtained from the description for the embodiment of FIG. 3, which is not repeated hereinafter. In the present embodiment, the driving signal V12 includes a plurality of frame periods F11 to F18. In correspondence to the frame periods F21 to F24, the driving signal V12 includes the common voltage level VCOMDC and the high level AVDD in each of the frame periods F11 to F14. The driving signal V12 is raised from the common voltage level VCOMDC to the high level AVDD. In correspondence to the frame periods F25 to F28, the driving signal V12 includes the low level AVSS and the common voltage level VCOMDC in each of the frame periods F15 to F18. The driving signal V12 is raised from the low level AVSS to the common voltage level VCOMDC. Therefore, in the present embodiment, the waveform of the driving signal V12 in each of the frame periods includes the high level AVDD and the common voltage level VCOMDC (in the frame periods F11 to F14), or the common voltage level VCOMDC and the low level AVSS (in the frame periods F15 to F18).

Hence, the waveform of the driving signal V11 and V12 in each of the frame periods is different from the waveform of the driving signal V2 in each of the frame periods. For instance, the waveforms of the driving signals V11 and V12 in the frame period F11 are different from the waveform of the driving signal V2 in the frame period F21. The waveforms of the driving signals V11 and V12 in the frame period F15 are different from the waveform of the driving signal V2 in the frame period F25. In the present embodiment, a time interval T1 of each of the frame periods F11 to F18 of the waveforms of the driving signals V11 and V12 is greater than a time interval T2 of each of the frame periods F21 to F28 of the waveform of the driving signal V2. In the present embodiment, the levels, the waveforms, and the numbers and lengths of the frame periods of the driving signals V11, V12 and V2 are merely examples, and the invention is not limited thereto.

The embodiments of FIG. 2 to FIG. 5 are described using the frame inversion method and the dot inversion method as examples, but the invention is not limited thereto. Enough teaching, suggestion, and implementation illustration regarding the line inversion method and the column inversion method can be obtained from the embodiments of FIG. 2 to FIG. 5, and thus related description thereof are not repeated hereinafter.

In summary, in the exemplary embodiments of the invention, the electronic paper display panel includes the transistor circuit back panel and the driver circuit of the liquid crystal display. Further, according to the driving principle of the liquid crystal display, the timing controller circuit can adjust the driving signal for the driver circuit so that the electronic paper display panel can be driven according to the driven waveform and can then display the image data. In other words, by directly replacing the liquid crystal layer of the liquid crystal display by the display film of the electronic paper together with the timing controller circuit of the invention, the existing liquid crystal display panel can then be utilized to drive the electronic paper display panel thereby saving the development costs.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims and their equivalents.

What is claimed is:

1. An electronic paper display, comprising:

a display apparatus of a first type;

a display film of a second type, wherein the display film of the second type is disposed on the display apparatus of the first type;

a driver circuit of the first type, electrically coupled to the display apparatus of the first type, and configured to drive the display apparatus of the first type and display an image frame on the display film of the second type according to a driving signal of the first type; and a timing controller circuit of the second type, electrically coupled to the driver circuit of the first type, and configured to adjust a waveform of a driving signal of the second type to a waveform of the driving signal of the first type, wherein the first type is a liquid crystal display (LCD) type, and the second type is an electronic paper display (EPD) type, wherein the electronic paper display is adapted to perform a waveform conversion for displaying images, and the waveform conversion provides waveform changes from a fourth level in a second frame period of an EPD driving signal to both a first level and a second level in a first frame period of an LCD driving signal, wherein the second frame period of the EPD driving signal corresponds to the first frame period of the LCD driving signal, and the first level in the first frame period is different from the second level in the first frame period.

2. The electronic paper display according to claim 1, wherein the waveform of the driving signal of the first type and the waveform of the driving signal of the second type each comprises a plurality of frame periods, and a time interval of each of the time periods of the waveform of the driving signal of the first type is greater than a time interval of each of the time periods of the waveform of the driving signal of the second type.

3. The electronic paper display according to claim 2, wherein the waveform of the driving signal of the first type in each of the frame periods is different from the waveform of the driving signal of the second type in each of the frame periods.

4. The electronic paper display according to claim 2, wherein the waveform of the driving signal of the first type in each of the frame periods comprises the first level and the second level, or the second level and a third level.

5. The electronic paper display according to claim 2, wherein the waveform of the driving signal of the second type in each of the frame periods comprises the fourth level or a fifth level.

6. The electronic paper display according to claim 1, wherein the driver circuit of the first type comprises a source driver circuit configured to drive the display apparatus of the first type utilizing a polarity inversion method.

7. The electronic paper display according to claim 6, wherein the display apparatus of the first type comprises a plurality of transistor circuits, and the driver circuit of the first type drives all the transistor circuits by the same waveform of the driving signal of the first type.

8. The electronic paper display according to claim 6, wherein the display apparatus of the first type comprises a plurality of first transistor circuits and a plurality of second transistor circuits, and the waveform of the driving signal of the first type for driving the first transistor circuits is different from the waveform of the driving signal of the first type for driving the second transistor circuits.

9. The electronic paper display according to claim 6, wherein the polarity inversion method is one selected from a frame inversion method, a line inversion method and a column inversion method and a dot inversion method.

* * * * *